US005765542A

United States Patent [19]

Fey et al.

[11] Patent Number: 5,765,542

[45] Date of Patent: Jun. 16, 1998

[54] COOKTOP GAS BURNER

[75] Inventors: Robert Martin Fey, Anaheim; Cyral Martin Walsh, Sherman Oaks, both of Calif.

[73] Assignee: Thermador Corporation, Los Angeles, Calif.

[21] Appl. No.: 794,460

[22] Filed: Feb. 4, 1997

Related U.S. Application Data

[63] Continuation of Ser. No. 375,914, Jan. 20, 1995, abandoned, which is a continuation-in-part of Ser. No. 367,800, Dec. 30, 1994, abandoned.

[51] Int. Cl.[6] ..... F24C 3/00

[52] U.S. Cl. ..... 126/39 E; 126/39 BA; 126/39 R; 431/266

[58] Field of Search ..... 431/266; 126/39 E, 126/39 R, 39 BA

[56] References Cited

U.S. PATENT DOCUMENTS 4,572,154 2/1986 Schweitzer ..... 126/39 E 4,968,246 11/1990 Sasada et al. ..... 126/39 E X 5,133,334 7/1992 Riehl ..... 126/39 R 5,328,357 7/1994 Riehl ..... 126/39 R X

FOREIGN PATENT DOCUMENTS 33528 3/1980 Japan ..... 126/39 E

*Primary Examiner*—Larry Jones

*Attorney, Agent, or Firm*—Brooks & Kushman P.C.

[57] ABSTRACT

A gas burner for maintaining a correct gas and air mixture for low-flame ignition. The gas burner includes a burner cap having a gas inlet and a plurality of gas outlets each having a predetermined diameter. The plurality of gas outlets are circumferentially spaced about a periphery of the cap and communicate with the gas inlet. The burner cap further includes an ignition enhancing outlet having a predetermined diameter and a longitudinal axis. The ignition enhancing outlet is aimed at the ignitor. Preferably, the longitudinal axis of the ignition enhancing outlet is aligned with the ignitor.

17 Claims, 2 Drawing Sheets

COOKTOP GAS BURNER

CROSS-REFERENCE TO RELATED APPLICATION

This is a continuation of application Ser. No. 08/375,914 filed on Jan. 20, 1995, now abandoned, which is a continuation-in-part of U.S. patent application Ser. No. 08/367,800 filed Dec. 30, 1994, now abandoned, entitled "Cooktop Gas Burner", which has, at all times relevant hereto, been commonly owned with the present application.

TECHNICAL FIELD

This invention relates generally to gas burner cooking appliances, and more particularly to such appliances having a low-flame gas burner control with a spark re-ignition system.

BACKGROUND ART

One of the energy-saving devices used on gas cooking appliances to eliminate the standing pilot is a spark ignition system. Spark ignition systems have become widely used in gas cooktops since the emergence of energy regulations which ban standing pilot lights. A typical spark ignition system will provide a spark when gas is supplied to a burner and no flame is sensed at that burner.

The flame sensing should be valid and the sparking of the ignitor should begin quickly in the absence of a flame and in the presence of gas. Most spark ignitors will provide a spark discharge at all of the burners on the cooktop when any one is turned on. There is some nuisance shock hazard associated with continued spark operation, although the amount of energy involved is usually not injurious. Nevertheless, the shock experienced by a user is very annoying.

Quick generation of a flame in response to a spark command is desirable to minimize nuisance shock hazard and noise from continued sparking. The sparking should be controlled so that it stops as soon as ignition occurs and remains off as long as the flame is present. To accomplish both of these requirements, ignition systems have been devised which use the electrical current rectification property of a flame, i.e., the ion cloud surrounding the flame, to sense the flame. These systems spark whenever the gas valve is on and a flame is not present. However, preferred operating procedures and equipment generally design ignition sparking for high volume gas flow or nearly maximum flame conditions, where gas and air mixtures are least affected by room air currents, breeze, overhead or otherwise located ventilation, or ignitor positions. These cooktop gas burners operating at low flame settings are not well adapted to avoid the effects of air movement or other ambient conditions.

Known prior art gas burners typically direct gas flow away from the ignitor so as to avoid engulfing the ignitor with a flame. If the ignitor is in the flame, it cannot sense the ion cloud and, thus, sense the flame to ensure proper operation of the ignition system. The gas flow is also generally directed away from the ignitor so as to generate the least amount of carbon monoxide. If the flame comes into contact with the ignitor, the flame cools before it has time to combust completely, thus generating carbon monoxide. However, this typical gas flow arrangement does not provide consistently good low-flame ignition characteristics because some environmental conditions can cause the gas-air mixture to be either too rich or too lean by the time it reaches the area of the spark path.

Another known burner system provides improved heat control by providing a low-energy cooking feature. Such cooking products may include controls for cycling gas flow and spark commands on and off to one or more burners. These systems generally operate at very low flame, and can provide a very low average heat output by shutting off the low gas flow for variable short periods of time, e.g., 10–50 seconds per minute. Shutting off the gas flow for variable short periods of time can reduce the average heat output below that output possible with control of only the continuous flow, thereby providing a low flame setting. However, at the low end of the sequenced setting, gas is flowing for about 10 seconds out of each minute. A few seconds delay in ignition shortens the 10 second burning period, and may even bypass an "ON" period altogether if ignition does not occur within the 10 second period. As a result, these burner systems are susceptible to long periods of spark ignition. Also, these systems are susceptible to annoying sparking noise and potential radio frequency interference generated by repeated sparking attempting to generate a flame.

DISCLOSURE OF THE INVENTION

The present invention overcomes the above-mentioned disadvantages by providing an improved gas flow pattern at the ignitor.

The present invention provides an improved gas flow pattern at the ignitor by aiming a low rate of gas flow at the ignitor.

In general, the present invention includes a gas burner having a burner cap and a burner base. The burner cap has a gas inlet and a plurality of gas outlets. The plurality of gas outlets are circumferentially spaced about a periphery of the cap and communicate with the gas inlet and an ignitor. The ignitor is generally located between the longitudinal axes of adjacent gas outlets. The gas burner further includes an ignition enhancing outlet aimed at the ignitor.

In the preferred embodiment, the ignition enhancing outlet is located on the burner cap between two adjacent gas outlets. The diameter of the ignition enhancing outlet is smaller than the diameter of each of the gas outlets. Performance is enhanced when the longitudinal axis of the ignition enhancing outlet is at an angle to the top surface of the ignitor.

The present invention also provides a gas burner control combining a pulsed sequence burner control with an improved gas flow pattern that maintains a correct gas and air mixture for low-flame ignition. In addition, the present invention provides an improved ignitor operation for low gas flow conditions by aiming gas flow toward the ignitor, preferably through the burner.

It is thus a general object of the present invention to provide a gas burner that assures fast, reliable ignition of the gas by a spark ignitor when the gas flow is restricted to a low rate.

It another object of the present invention to provide a gas burner that reduces annoying sparking noise and potential radio frequency interference generated by controlling gas flow to the ignitor in order to avoid unnecessary sparking.

It is yet another object of the present invention to provide a cooktop gas burner that provides correct gas and air mixture for low-flame ignition without adversely changing the high flame ignition or flame rectification sensing.

It is yet a further object of the present invention to provide an effective ignition enhancing mechanism which can be economically implemented.

The above objects, features and advantages of the present invention, as well as others, are readily apparent from the following detailed description of the best mode for carrying out the invention when taken in connection with the accompanying drawings.

BRIEF DESCRIPTION OF THE DRAWINGS

The present invention will be more clearly understood by reference to the following detailed description of a preferred embodiment when read in conjunction with the accompanying drawing in which like reference characters refer to like parts throughout the views and in which.

BEST MODE FOR CARRYING OUT THE INVENTION

Figure 1:
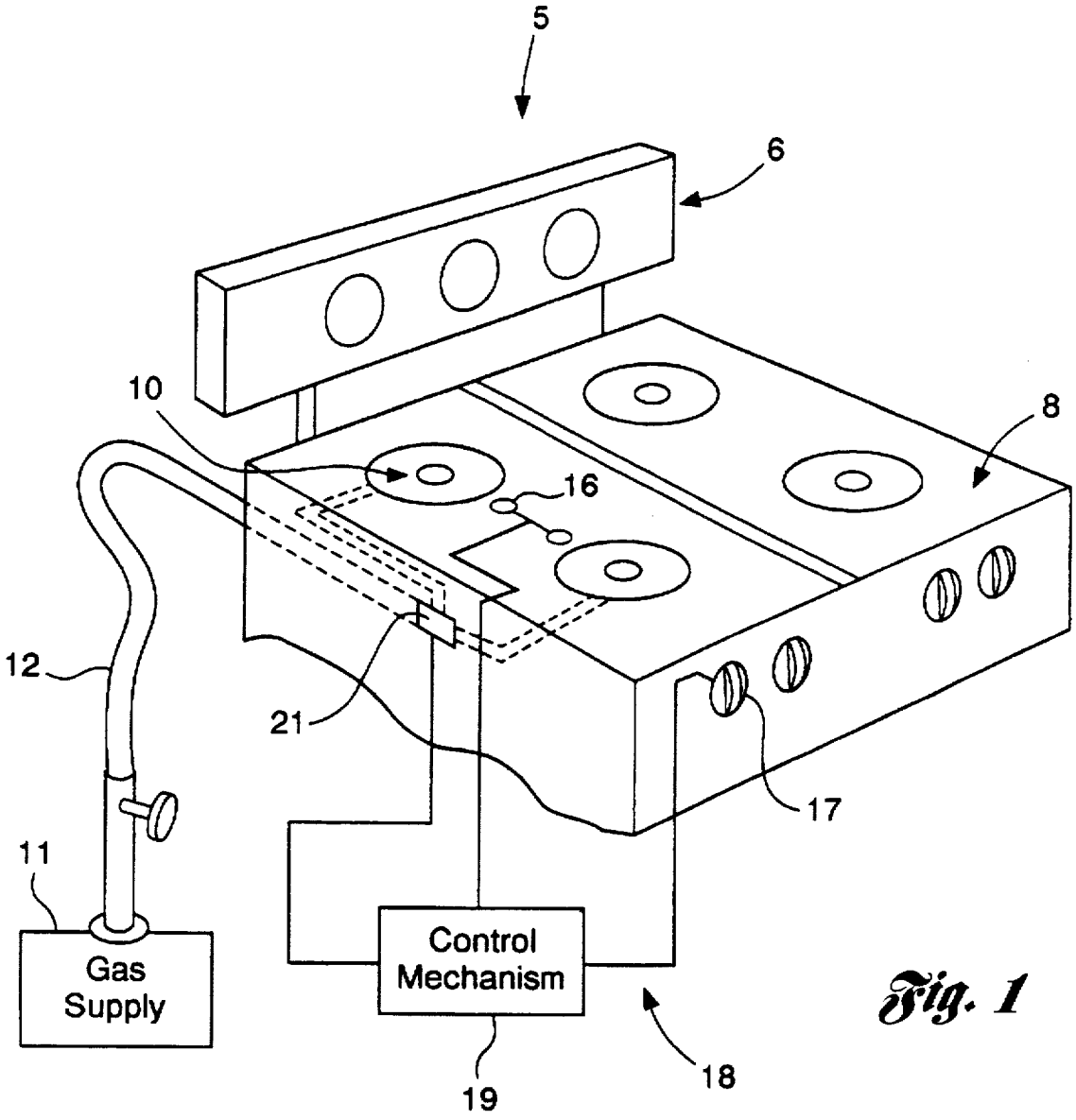
FIG. 1 is a perspective view of a cooking appliance with a cooktop constructed according to the present invention.

Turning now to FIG. 1, there is shown an appliance, denoted generally by reference numeral 5. The appliance 5 includes a range 6 having a cooktop 8. The cooktop 8 includes at least one gas burner 10 incorporating an improved gas flow pattern according to the present invention. Each burner 10 is associated with a corresponding ignitor 16. The range 6 receives gas from a gas supply 11 via a pipe 12.

The range 6 also includes at least one actuator 17 for each burner 10. The actuator 17 adjusts the flow rate of gas that is supplied to the burner 10 from the gas supply 11.

The cooktop 8 preferably incorporates a pulse sequenced control for at least one burner. One known cooktop with a pulse sequenced control is disclosed in U.S. patent application Ser. No. 08371,597, filed Jan. 12, 1995, entitled "Stove Burner Simmer Control", which is a file wrapper continuation of U.S. patent application Ser. No. 08/219,388, filed Mar. 29, 1994, entitled "Stove Burner Simmer Control" which is hereby incorporated in its entirety by reference.

The sequenced control system, denoted generally by reference numeral 18, includes a control mechanism 19 coupled to the actuator 17 and a valve 21 for controlling the volume of gas delivered from the gas supply 11. The control mechanism 19 is a microcontroller-based control module that switches both the ignitor 16 and the valve 21 to the burner 10 in a predetermined time sequence in response to a user's selective manipulation of the actuator 17. This type of sequenced control system 18 eliminates the need for two knobs or actuators to control both the gas flow and the ignitor 16.

Figure 2:
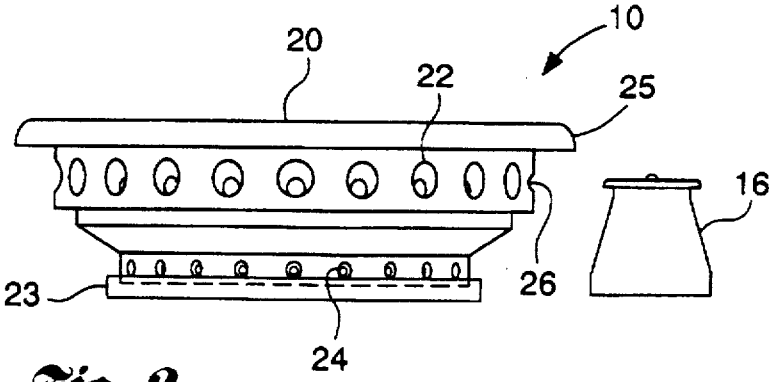
FIG. 2 is a side view of a portion of the cooktop shown in FIG. 1.

Referring now to FIG. 2, there is shown a side view of a burner 10 incorporating an improved gas flow pattern according to the present invention. The gas burner 10 includes a burner cap 20 and a burner base 23. Gas is directed to the burner 10 via a gas inlet 14. The burner cap 20 includes a plurality of gas outlets 22. The gas outlets 22 are circumferentially spaced about the periphery of the burner cap 20 and allow for gas to flow to form a ring of flame around the edge of the burner 10. One or more of the gas outlets 22 are positioned near the ignitor 16 for ignition of the initial gas flow.

The burner cap 20 generally includes an overhang 25. The overhang 25 is not required, but is preferred in order to prevent the gas outlets 22 from becoming contaminated or clogged by food or liquids falling from the cooktop 8.

The burner cap 20 also includes a plurality of carryover outlets 24 that facilitate the flow of the gas flame from one gas outlets 22 to another by providing a thin layer of gas which flows upwardly past the main gas outlets 22 and thereby allowing a small flame to burn between the outlets 22.

The present invention applies to other burner configurations than the one illustrated in FIG. 2. For example, the burner 10 may comprise a plurality of gas tubes directed outward and arranged in a circular manner. The plurality of tubes would correspond to the plurality of gas outlets 22 of FIG. 2.

The ignitor 16 is exposed to the gas outlets 22 to generate a flame when a charge is provided to the ignitor 16. When the valve 21 is on and a flame is not sensed, spark energy is provided to the ignitor 16 so as to ignite the gas.

Figure 3:
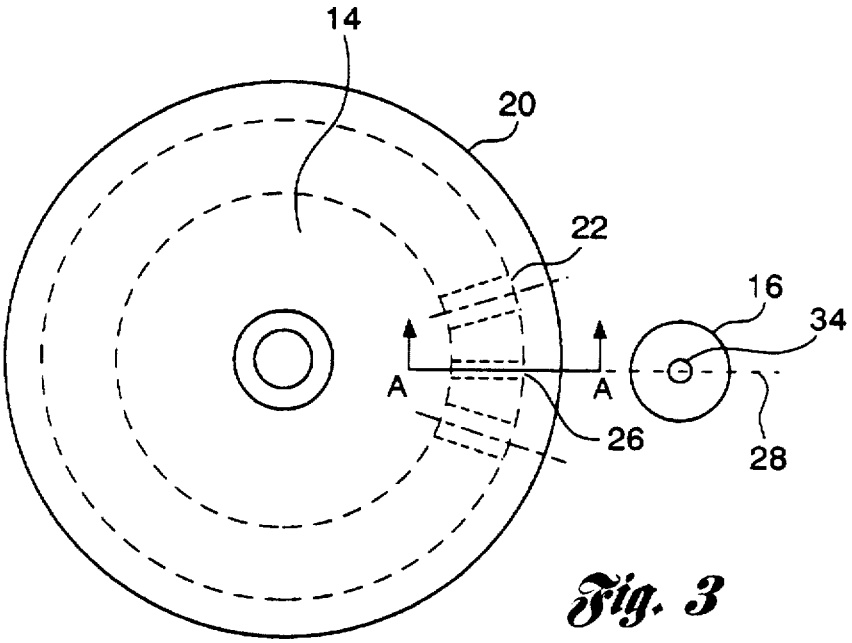
FIG. 3 is a top view of the cooktop portion shown in FIG. 2.

An additional outlet 26 to enhance ignition is added to the burner cap 20 to facilitate low-flame ignition. The ignition enhancing outlet 26 is located on the periphery of the burner cap 20 between two adjacent gas outlets 22, as shown in FIGS. 2 and 3. The ignition enhancing outlet 26 is aimed at the ignitor 16 so as to provide a proper gas-air mixture to the ignitor 16 for low flame ignition. The ignition enhancing outlet 26 is small so its flame does not engulf the ignitor, even when aligned in direct radial alignment with the center of the ignitor. As shown in FIG. 3, the two adjacent outlets 22 are not aligned at the ignitor.

Figure 4:
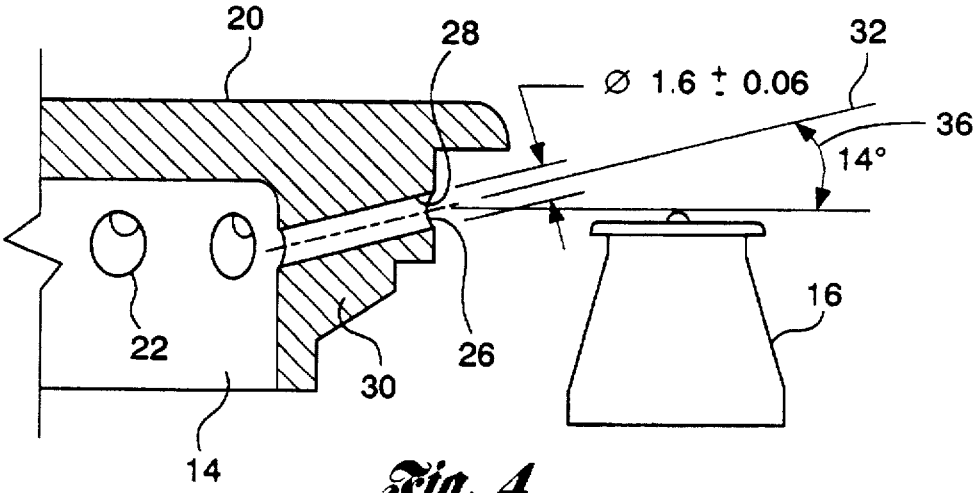
FIG. 4 is a cross-sectional view along A—A of FIG. 3.

As shown in FIG. 4, the ignition enhancing outlet 26 is defined by an elongated passageway 28 extending through an annular wall 30 of the burner cap 20. The passageway 28 has a longitudinal axis 32 extending radially outward from the burner cap 20. The ignition enhancing outlet 26 is aimed at the center 34 of the ignitor 16. Preferably, the longitudinal axis 32 of the passageway 28 of the ignition enhancing outlet 26 is aligned with the center 34 of the ignitor 16.

The ignition enhancing outlet 26 may be either a drilled, cast, or machined hole or notch that provides the improved gas and air mixture for low-flame ignition without adversely changing the high flame ignition, carbon monoxide, or flame sensing at other flame conditions.

Preferably, the diameter of the ignition enhancing outlet 26 is smaller than the diameter of each of the gas outlets 22. A preferred diameter of the ignition enhancing outlet 26 is in the range of 1.5 mm to 1.6 mm as providing sufficient gas-air mixture for ignition, yet still not support a flame large enough to engulf the ignitor.

For manufacturing economy, it is preferred that the ignition enhancing outlet 26 have the same angle with respect to a horizontal plane as the gas outlets 22, preferably 10°–15°. In addition, performance at low-flame ignition is enhanced when the longitudinal axis 32 of the ignition enhancing outlet 26 is at an angle to the top surface of the ignitor 16. A preferred angle is about 14 degrees as it directs the gas flow above the ignitor 16 at high control settings. The passageway 28 is then aligned so that it directs gas flow from the ignition enhancing outlet 26 entirely above the top of the ignitor 26. Thus, the gas flow is positioned above the ignitor 16 for improved spark ignition.

While the best modes for carrying out the invention have been described in detail, those familiar with the art to which this invention relates will recognize various alternative designs and embodiments for practicing the invention as defined by the following claims.

What is claimed is:

1. A cooktop having a source of gas, comprising:

an ignitor;

a burner having a gas inlet for receiving gas from the gas source, and a plurality of gas outlets each having a predetermined diameter circumferentially spaced about a periphery of the burner, the plurality of gas outlets in communication with the gas inlet, and the burner further having at least one ignition enhancing outlet at the periphery of the burner, the at least one ignition enhancing outlet in communication with the gas inlet and having a predetermined diameter smaller than said predetermined diameter so as to direct an additional portion of a low volume of gas at the ignitor and above the top of the ignitor at the periphery of the burner; and a pulse sequenced control system for periodic ignition of the low volume of gas.

2. The cooktop as recited in claim 1 wherein the burner comprises a burner cap having a top surface and an annular wall having a predetermined thickness supporting the top surface, and wherein the plurality of gas outlets and the at least one ignition enhancing outlet comprising a plurality of outlet passageways extending through the annular wall having one end communicating with the gas inlet and the other end extending radially outward from the annular wall, each of the plurality of passageways each having a longitudinal axis.

3. The cooktop as recited in claim 2 wherein the longitudinal axis of the passageway of the at least one ignition enhancing outlet is aligned with the ignitor.

4. The cooktop as recited in claim 2 wherein the longitudinal axis of the at least one ignition enhancing outlet is at an angle with respect to a top surface of the ignitor.

5. The cooktop as recited in claim 4 wherein the angle is in the range of 10–15 degrees.

6. The cooktop as recited in claim 1 wherein the pulse sequenced control system includes a control mechanism for controlling both the source of gas and the ignitor.

7. A burner for a cooktop having an ignitor and a pulse sequenced control system for periodic ignition of a low volume gas, the burner comprising:

a gas inlet for receiving gas from a gas source;

a plurality of gas outlets each having a predetermined diameter and circumferentially spaced about a periphery of the burner, and the plurality of gas outlets in communication with the gas inlet; and at least one ignition enhancing outlet at the periphery of the burner between two adjacent outlets of said plurality of gas outlets adjacent to the ignitor and in communication with the gas inlet and having a predetermined diameter portion smaller than said predetermined diameter of said adjacent outlets so as to direct an additional portion of a low volume of gas at the ignitor during periodic ignition of the low volume gas.

8. The burner as recited in claim 7 wherein the predetermined diameter of the at least one ignition enhancing opening is smaller than the predetermined diameter of each of the plurality of gas outlets.

9. The burner as recited in claim 7 wherein the burner comprises a burner cap having a top surface and an annular wall having a predetermined thickness supporting the top surface, and wherein the plurality of gas outlets and at least one ignition enhancing outlet extending through the annular wall comprising a plurality of outlet passageways having one end communicating with the gas inlet and the other end extending radially outward from the annular wall, each of the plurality of passageways each having a longitudinal axis.

10. The burner as recited in claim 9 wherein the longitudinal axis of the passageway of the at least one ignition enhancing outlet is aligned with the ignitor.

11. The burner as recited in claim 9 wherein the longitudinal axis of the at least one ignition enhancing outlet is at an angle with respect to a top surface of the ignitor.

12. The burner as recited in claim 11 wherein the angle is in the range of 10–15 degrees.

13. The burner as recited in claim 7 wherein the pulse sequenced control system includes a control mechanism for controlling both the source of gas and the ignitor.

14. The invention as defined in claim 1 wherein said at least one ignition enhancing outlet is between two adjacent outlets of said plurality of gas outlets.

15. The invention as defined in claim 7 wherein said two adjacent outlets are not aligned at said ignitor.

16. The invention as defined in claim 7 wherein said at least one ignition enhancing outlet is above the top of the ignitor.

17. The invention as defined in claim 7 wherein said two adjacent outlets are not aligned at said ignitor.

* * * * *